US005231409A

United States Patent [19]

Astier et al.

[11] Patent Number: 5,231,409

[45] Date of Patent: Jul. 27, 1993

[54] MICROWAVE ANTENNA CAPABLE OF OPERATING AT HIGH TEMPERATURE, IN PARTICULAR FOR A SPACE-GOING AIRCRAFT

[75] Inventors: Jean-Pierre Astier, Pessac; Christian Bertone, Castelnau de Medoc; Alain Dujardin, Saint-Medard-en-Jalles, all of France

[73] Assignee: Societe Europeenne De Propulsion, Suresnes, France

[21] Appl. No.: 464,983

[22] Filed: Jan. 16, 1990

[30] Foreign Application Priority Data

Jan. 19, 1989 [FR] France ..... 89 00627

[51] Int. Cl.[5] ..... H01Q 1/28

[52] U.S. Cl. ..... 343/705; 343/708

[58] Field of Search ..... 343/705, 708, 776, 785

[56] References Cited

U.S. PATENT DOCUMENTS

| | | | |
|---|---|---|---|
| 3,255,457 | 6/1966 | Hannan | 343/776 |
| 3,522,561 | 8/1970 | Liu | 333/95 |
| 3,553,706 | 1/1971 | Charlton | 343/776 |
| 3,577,147 | 5/1971 | Hannan | 343/785 |
| 3,680,138 | 7/1972 | Wheeler | 343/756 |
| 3,991,248 | 11/1976 | Bauer | 428/245 |
| 4,007,460 | 2/1977 | Hanfling et al. | 343/776 |
| 4,358,772 | 11/1982 | Leggett | 343/872 |
| 4,576,836 | 3/1986 | Colmet et al. | 427/255 |
| 4,621,485 | 11/1986 | Argazzi | 53/564 |
| 4,666,873 | 5/1987 | Morris, Jr. et al. | 501/96 |
| 4,700,195 | 10/1987 | Boan et al. | 343/DIG. 2 |
| 4,709,240 | 11/1987 | Bordenave | 343/772 |
| 4,748,449 | 5/1988 | Landers, Jr. et al. | 343/705 |
| 4,790,052 | 12/1988 | Olry | 28/110 |
| 4,847,506 | 7/1989 | Archer | 343/873 |

FOREIGN PATENT DOCUMENTS

| | | | |
|---|---|---|---|
| 492292 | 4/1953 | Canada | 343/785 |

*Primary Examiner*—Rolf Hille
*Assistant Examiner*—Hoanganh Le
*Attorney, Agent, or Firm*—Weingarten, Schurgin, Gagnebin & Hayes

[57] ABSTRACT

A microwave antenna capable of operating at high temperature comprises at least one waveguide opening to the outside through an opening in a covering panel and including a tubular portion integrally formed with the panel, projecting inwards therefrom, and connected to the remainder of the panel around the opening, the panel and the integrated waveguide being made of a refractory composite material capable of ensuring microwave propagation and constituting a structural element capable of being raised to high temperature. The waveguide is filled with a refractory dielectric material such as an alumina-alumina type composite material.

11 Claims, 1 Drawing Sheet

MICROWAVE ANTENNA CAPABLE OF OPERATING AT HIGH TEMPERATURE, IN PARTICULAR FOR A SPACE-GOING AIRCRAFT

The present invention relates to a microwave antenna capable of operating at high temperature.

BACKGROUND OF THE INVENTION

A particular field of application for the invention is antennas intended to be fitted to apparatuses, missiles, or vehicles, in particularly space-going aircraft, and to be fitted to portions thereof which are subjected to high levels of heating in operation.

For a space-going aircraft, antennas are placed in zones which are exposed to heating due to friction on layers of the atmosphere, in particular around the nose of the apparatus. In such zones, the external structures are constituted, for example, by juxtaposed panels of refractory material, and a known way of protecting antennas against heating is to mask them behind a heat shield. The material from which the heat shield is made must then have low permittivity and very low attenuation losses and must retain these dielectric properties even at very high temperatures. Various materials have been proposed for this purpose, e.g. in the following patent documents: FR 2 483 689, FR 2 553 403, and U.S. Pat. No. 4,358,772.

The object of the invention is to provide a microwave antenna capable of operating at very high temperature without it being necessary to mask it completely by means of a heat shield.

SUMMARY OF THE INVENTION

This object is achieved, according to the invention, by the antenna comprising at least one waveguide opening to the outside through an opening in a covering panel and including a tubular portion integrally formed with the panel, projecting inwards therefrom, and connected to the remainder of the panel around the opening, the panel and the integrated waveguide being made of a refractory composite material capable of ensuring microwave progagation and constituting a structural element capable of being raised to high temperature.

By making a waveguide integrally with a panel it is possible for the antenna to be genuinely integrated in a structural assembly which also has the function of providing a heat shield with there being radioelectrical continuity between the waveguide and the structure. Connection problems, in particular because of differential expansion, that could otherwise arise with the components of the antenna and the structure of the heat shield being made separately are thus avoided.

The antenna may comprise an array of several waveguides formed in a single panel or in adjacent panels.

The material from which the panel-waveguide assembly is made serves both to provide a heat shield function and a mechanical function. It is also necessary for this material to retain its microwave propagation ability at very high temperatures: not less than 1000° C., and preferably at least 1500° C.

This material is selected from composite materials having refractory fiber reinforcement (carbon fibers or ceramic fibers) and a refractory matrix (carbon matrix, ceramic matrix, or a matrix comprising a mixture of carbon and ceramic). A composite material of the C/C-SiC type (carbon fiber reinforcement in a matrix comprising a mixture of silicon carbide and carbon) has been found to satisfy the required conditions. The composite material may also be provided, in conventional manner, with protection against oxidization.

Since the waveguide opens out to the outside, it is advantageously packed with a refractory material that provides surface continuity for the panel. The packing material should withstand thermal shock well and should have good resistance to erosion. It should also be insensitive to humidity and its coefficient of expansion should be substantially equal to that of the composite material from which the panel and waveguide assembly is made. Naturally, the packing material should have dielectric properties of low permittivity and low loss, and it should retain these properties at high temperatures. The packing material is advantageously a refractory composite material of the oxide-oxide or ceramic-ceramic type, e.g. an alumina-alumina composite.

At its end opposite to the end connected to the remainder of the panel, the waveguide may be extended by a ring of refractory material connected to the body of the antenna and constituting a thermal barrier, e.g. a ring of pyrographite.

BRIEF DESCRIPTION OF THE DRAWING

An embodiment of the invention is described by way of example with reference to the accompanying drawing, in which.

DETAILED DESCRIPTION

Figure 1:
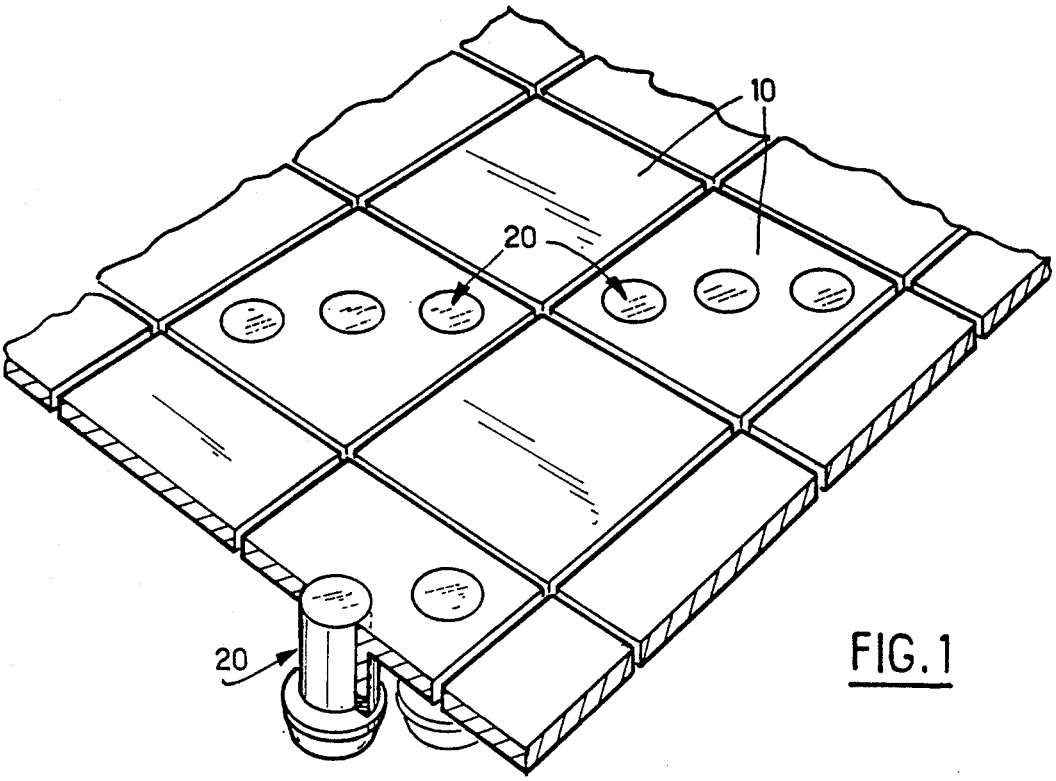
FIG. 1 is a diagrammatic view of a portion of an external heat shield structure formed by juxtaposed panels in which an antenna is integrated.

FIG. 1 is a diagram showing a portion of a structure formed by juxtaposing panels or tiles 10 made of refractory material and intended, for example, for use on a hypersonic missle or a space vehicle. The panels 10 constitute structural members forming a part of the airframe of the missle or space-going aircraft, and they also provide a heat shield providing protection against heating due to friction on the gas layers of the Earth's atmosphere.

Communication with the missile or space vehicle is provided by means of antennas, each comprising a waveguide 20 or an array of waveguides 20 which, in accordance with the invention, are integrated in the structure constituting the heat shield. To this end, each waveguide is constituted integrally with a covering panel 10. A single panel may have one or several waveguides associated with the same antenna, optionally in combination with one or several waveguides integrated in an adjacent panel. FIG. 1 shows panels 10 which are substantially square in shape each having three waveguides 20 in alignment along a diagonal of the panel. Panels provided with waveguides and panels without waveguides have the same outside dimensions such that there is no particular difficulty in assembling the panels when one or more antennas are integrated in the structure.

Figure 2:
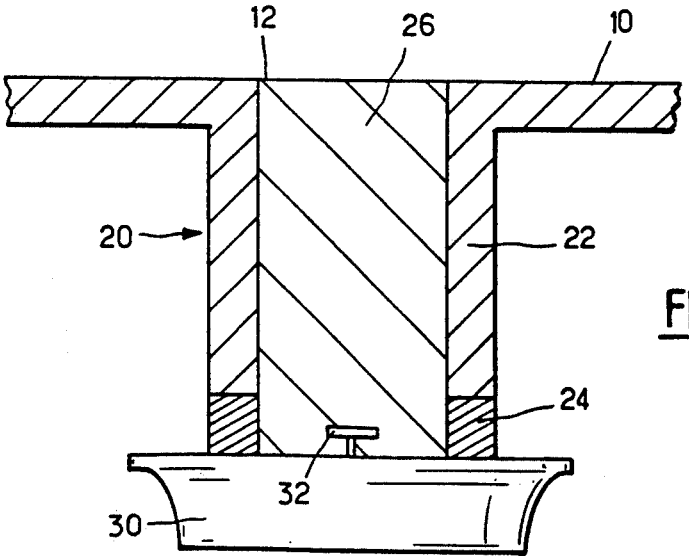
FIG. 2 is a section view through a panel of the FIG. 1 heat shield on a larger scale and showing a waveguide forming a part of the antenna.

As shown in FIG. 2, each waveguide 20 comprises a tubular portion 22 integrally formed with the panel 10 with which the waveguide is integrated. In the example shown, the tubular portion 22 is circular in section. Any other shape could be given to this section, e.g. square, rectangular, or elliptical.

The tubular portion 22 projects from the inside of the panel 10 and is connected to the remainder of the panel around an opening 12 through the panel 10 through which the waveguide is open to the outside. The other end of the waveguide 20 is extended by a ring 24 of insulating material constituting a thermal barrier and connecting the waveguide to an antenna body 30 from which there projects a probe 32 for exciting an electromagnetic field at the inboard end of the waveguide. Since the waveguide 20 is open to the outside, it is filled with a refractory dielectric material 26 which provides surface continuity of the panel for aerodynamic reasons.

The material from which the panel 10 and the portion 22 of the waveguide are made is a structural thermal refractory composite material obtained by using a fibrous reinforcing material to constitute a preform of the parts to be made and then densifying the preform by infiltration or by impregnation using matrix material to occupy the pores of the reinforcement. The fiber reinforcement is made of refractory fibers, e.g. carbon fibers or ceramic fibers, such as silicon carbide fibers. The fibers may, for example, be in the form of layers of cloth which are laid on top of one another and bonded by needling. The manufacture of plane or cylindrical fiber reinforcements by stacking two-dimensional layers and then needling is described in French patent applications numbers 2 584 106, 2 584 107, and 88 13 132. Densification is performed by chemical vapor infiltration, for example. The techniques of infiltrating carbon or ceramic such as silicon carbide by chemical vapor infiltration are well known. Reference can be made, for example, to French patent applications numbers 2 189 207 and 2 401 888. When using a ceramic matrix material, fiber-matrix bonding is improved by forming an intermediate or interphase layer on the fibers using a lamellar material, such as a pyrolytric carbon as described in French patent application number 2 567 874.

In order to form a panel 10 integrally with a plurality of tubular portions 22 using composite material of the C/C-SiC type, the following procedure may be followed, for example.

A plate-shaped fiber preform for the panel and cylindrical fiber preforms for the tubular portions 22 are made separately by stacking and needling layers of carbon fiber cloth, as described above. Openings 12 are then cut in the panel preform at the designed locations for the waveguides, after which the panel preform and the tubular preforms are assembled and held together, e.g. by tooling. The material constituting the matrix is then infiltrated simultaneously into all of the assembled preforms. By co-densifying the preforms in this way, the tubular portions are integrated with the remainder of the panel by virtue of the continuity of the matrix material at the interfaces between the assembled preforms. The matrix is obtained by chemical vapor infiltration of carbon followed by a final densification stage by chemical vapor infiltration of silicon carbide.

Electromagnetic characterization tests on the composite material obtained in this way have shown that the reflection coefficient of the material remains greater than 0.99 in modulus and equal to $180° \pm 1°$ in phase up to a temperature of 1800° C. The attenuation due to the waveguide is less than 0.5 dB per wavelength at ambient temperature. Electrical conductivity increases with temperature, going from about $5.10^3$ mhos per centimeter (S/cm) at ambient temperature to about $5.10^4$ S/cm at 1800° C., thereby minimizing resistive losses in operation.

The ring 24 acting as a thermal barrier at the inboard end of the waveguide is made, for example, of pyrographite which has thermal conductivity properties in one of its planes while providing thermal insulation in a perpendicular direction. The ring 24 is made in such a manner as to obtain thermal insulation in the axial direction and thermal conductivity in the radial direction.

The packing material 26 is a ceramic-ceramic composite such as an alumina-alumina type composite constituted by a mass of silico alumina fibers densified with alumina by a liquid impregnation method or by a chemical vapor infiltration method, as described, for example, in European patent number 0 085 601. Such a material withstands thermal shocks and erosion, is insensitive to humidity, and has a coefficient of expansion close to that of the C/C-SiC composite material used for the assembled panel 10 and tubular waveguide portion 22. At microwaves, the permittivity $\epsilon'$ of the packing material is 3.2, and loss is expressed by $\tan \delta = 2.4 \times 10^3$. It should be observed that the packing 26 does not contribute to the mechanical strength of the panel. There is therefore no need to use a material having special mechanical properties. Ceramic fillers, e.g. in the form of a boron nitride powder, may be incorporated in the packing material 26, in particular by being dispersed throughout the matrix which is formed by liquid impregnation, thereby reducing permittivity and dielectric losses in the material. In addition, permittivity and dielectric loss can be adjusted by acting on the density of the packing material, which density is adjusted by the conditions under which the material is densified by the matrix.

In order to assemble the packing material 26 with the waveguide 20 the following procedure may be followed. The alumina mat constituting the preform of packing material is preimpregnated with aluminum oxychloride.

The preform obtained in this way is machined to the dimensions of the waveguide and is inserted therein. The parts are subsequently bonded together by heat treatment in an inert atmosphere at a temperature of about 900° C.

A finishing treatment including, in particular, depositing a protective layer e.g. an alkali silicate as described in French patent application FR 88 16 862, may be applied to the assembly constituted by the panel, the waveguide, and the packing material in order to provide protection against oxidation and against humidity.

We claim:

1. A microwave antenna for operation at high temperatures on a surface of an atmospheric vehicle, comprising:

a refractory composite material panel forming part of the surface of said vehicle and connected to said vehicle as a structural member thereof;

at least one waveguide integrally formed in said panel from said refractory composite material, each waveguide comprising a tubular portion integrally formed with said panel and projecting inward from said panel so as to provide an opening in said panel through said tubular portion;

an antenna body within said vehicle and connected to said tubular portion across said opening; and said panel and said tubular portion being formed in one piece and made of refractory composite material capable of ensuring microwave propagation and maintaining structural integrity when heated to high temperatures characteristic of atmospheric friction on hypersonic missiles and space vehicles.

2. An antenna according to claim 1, wherein the opening is packed with a refractory dielectric material.

3. An antenna according to claim 2, wherein the packing material is essentially an alumina-alumina type composite material.

4. An antenna according to claim 1, wherein the material constituting the panel is a thermal structural composite material selected from carbon-carbon composite materials and composite materials having a matrix which is ceramic, at least in part.

5. An antenna according to claim 4, wherein the composite material constituting the panel is a composite material reinforced by carbon fibers and having a matrix constituted by a carbon-ceramic mixture.

6. An antenna according to claim 1, wherein the antenna body is connected to said tubular portion by a ring of refractory material which constitutes a thermal barrier between the tubular portion and the antenna body.

7. An antenna according to claim 6, wherein the ring is made of pyrographite.

8. An antenna according to claim 1, including a plurality of waveguides each comprising a tubular portion formed integrally with a common panel.

9. An antenna according to claim 1, comprising a plurality of waveguides comprising a plurality of tubular portions integrally formed with respective adjacent panels.

10. An antenna according to claim 1, wherein said panel and said at least one waveguide are structural members of an airframe of a hypersonic missile and provide at least some heat shielding therefore.

11. An antenna according to claim 1, wherein the integrated panel and waveguide is a structural member of the airframe of a space-going aircraft and provides heat shielding therefore.

* * * * *